US007380583B2

(12) United States Patent
Gallerneault et al.

(10) Patent No.: US 7,380,583 B2
(45) **Date of Patent: *Jun. 3, 2008**

(54) BELT CASTING OF NON-FERROUS AND LIGHT METALS AND APPARATUS THEREFOR

(75) Inventors: Willard Mark Truman Gallerneault, Kingston (CA); Kevin Michael Gatenby, Kingston (CA); Iljoon Jin, Kingston (CA); Ronald Roger Desrosiers, Kingston (CA)

(73) Assignee: Novelis Inc., Toronto, Ontario (CA)

( * ) Notice: Subject to any disclaimer, the term of this patent is extended or adjusted under 35 U.S.C. 154(b) by 3 days.

This patent is subject to a terminal disclaimer.

(21) Appl. No.: 10/574,459

(22) PCT Filed: Oct. 1, 2004

(86) PCT No.: PCT/CA2004/001782

§ 371 (c)(1),
(2), (4) Date: Dec. 21, 2006

(87) PCT Pub. No.: WO2005/032744

PCT Pub. Date: Apr. 14, 2005

(65) Prior Publication Data

US 2007/0209778 A1 Sep. 13, 2007

(51) Int. Cl.
*B22D 11/06* (2006.01)

(52) U.S. Cl. ..... 164/481; 164/431; 164/432

(58) Field of Classification Search ..... 164/481, 164/431, 432

See application file for complete search history.

(56) References Cited

U.S. PATENT DOCUMENTS

| | | | | |
|---|---|---|---|---|
| 3,414,043 | A | 12/1968 | Wagner | |
| 4,008,750 | A | 2/1977 | Sivilotti | |
| 4,061,177 | A | 12/1977 | Sivilotti et al. | |
| 4,061,178 | A | 12/1977 | Sivilotti et al. | |
| 4,190,103 | A | 2/1980 | Sivilotti | |
| 4,915,158 | A | 4/1990 | Wood | |
| 4,934,443 | A | 6/1990 | Honeycutt et al. | |
| 5,616,189 | A | 4/1997 | Jin et al. | |
| 5,636,681 | A | 6/1997 | Sulzer et al. | |
| 6,063,215 | A | 5/2000 | Harrington | |
| 2001/0039890 | A1* | 11/2001 | Zimmer et al. | 101/126 |

FOREIGN PATENT DOCUMENTS

| | | | |
|---|---|---|---|
| FR | 1364717 | | 5/1964 |
| GB | 519 978 | A | 4/1940 |
| JP | 55-33917 | * | 3/1980 |
| JP | 61-20976 | * | 1/1986 |
| WO | WO 02/11922 | A2 | 2/2002 |

* cited by examiner

*Primary Examiner*—Kuang Lin
(74) *Attorney, Agent, or Firm*—Cooper & Dunham LLP

(57) ABSTRACT

A casting belt for using in a single-belt or twin-belt casting apparatus is disclosed. The casting belt is made of aluminum alloy such as an alloy from the AA5XXX and AA6XXX systems, preferably having a thickness in the range of 1 to 2 mm. The aluminum casting belt of the invention is suitable for casting non-ferrous and light metals such as aluminum, magnesium, copper, zinc and their alloys, especially aluminum alloys such as Al—Mg, Al—Mg—Si, Al—Fe—Si and Al—Fe—Mn—Si alloy systems. A belt casting machine and process using the aluminum casting belt of the invention are also disclosed.

17 Claims, 6 Drawing Sheets

BELT CASTING OF NON-FERROUS AND LIGHT METALS AND APPARATUS THEREFOR

This application is a U.S. National Phase Application of PCT International Application PCT/CA2004/001782.

TECHNICAL FIELD

This invention relates to casting belts employed in belt casting machines used for the casting of non-ferrous and light metals such as aluminum, magnesium, copper, zinc and their alloys. More particularly, the invention relates to metal casting belts made of materials having good thermal and other physical properties.

BACKGROUND ART

Twin-belt casting machines have been used for casting metals for quite some time. In machines of this kind, endless belts rotating in race-track patterns are positioned one above the other (or, in some cases, side-by-side) with generally planar parallel runs of each belt positioned closely adjacent to each other to define a mold therebetween. Molten metal is introduced into the mold at one end and the metal is drawn through the mold by the moving belt surfaces. Heat from the molten metal is transferred through the belts, and this transfer is assisted by cooling means, such as water sprays, acting on the opposite sides of the belts in the regions of the mold. In consequence, the metal solidifies as it passes through the mold, and a solid metal slab or strip emerges from the opposite end of the mold. For example, improved casting machines of this kind are described in U.S. Pat. Nos. 4,008,750 and 4,061,177 issued respectively on Feb. 22, 1977 and Dec. 6, 1977 to the same assignee as the present application. The casting machines also use high efficiency coolant application systems such as are described in U.S. Pat. No. 4,193,440 issued on Mar. 18, 1980 to the same assignee as the present application and in International Application Publication WO 02/11922 filed on Aug. 7, 2001 also by the same assignee as the present application. The disclosures of all these publications are incorporated herein by reference.

These casting machines, with their high efficiency coolant application systems, operate by creating a thin, high velocity stream of coolant behind the casting belt. This results in a high maximum heat transfer coefficient between coolant and belt. The belt in addition "floats" on the coolant layer in the critical areas of the casting, rather than merely being supported between pulleys.

The belts used in casting machines of this kind are usually made of textured steel or, less commonly, of copper. Such materials are disclosed in, for example, U.S. Pat. No. 5,636,681 issued on Jun. 10, 1997 to the same assignee as the present application. Furthermore, U.S. Pat. No. 4,915,158 issued on Apr. 10, 1990 and assigned to Hazelett Strip-Casting Corporation discloses a copper belt providing a backing for a ceramic coating. However, belts made of these materials (particularly those made of copper) are expensive to manufacture and copper belts are susceptible to "plastic set" (i.e. distortion due to handling or lack of external support systems). Moreover, steel belts tend to have thermal conductivities that are suitable only for casting non-ferrous and light metal alloys of one kind, whereas copper belts have thermal conductivities suitable for non-ferrous and light metal alloys of another kind. For example, textured (e.g. shot-blasted) steel belts may be used for many relatively short freezing range aluminum alloys, such as fin or foil alloys, whereas copper belts are required for surface critical applications, e.g. for automotive aluminum alloys having longer freezing ranges than normal. A process for casting such automotive alloys using the high heat flux capability of copper belts is disclosed in U.S. Pat. No. 5,616,189 issued on Apr. 1, 1997 to the same assignee as the present application. In that reference, heat fluxes as high as 4.5 $MW/m^2$ are found suitable, and such heat fluxes normally require the use of Cu belts. Other long freezing range alloys, for example those described in Leone et al., Alcan Belt Casting Mini-Mill Process, May 1989, are preferably cast at even higher heat fluxes (over 5 $MW/m^2$).

However, due to the higher thermal conductivity of copper belts, such belts cannot be used to cast light gauge alloys due to the onset of a casting defect referred to as "shell distortion" (caused by a variation in ingot cross-section resulting from regions of higher heat transfer formed adjacent to low heat transfer regions, i.e. uneven heat removal). Consequently, when the casting apparatus is used for casting a variety of non-ferrous metal alloys, it is frequently necessary to change the belts from steel to copper or vice versa between casting operations. This is time consuming, expensive and troublesome. In modern casters of the type described above, it is desired as well that they operate at a wide range of throughput, also requiring easy operation at high heat fluxes.

Moreover, Applicants have found that textured steel belts require the use of a different parting agent application system than copper belts (brushes versus rotating atomizing bells and a cleaning box), so that it is necessary to change the parting agent application system when changing alloy systems. U.S. Pat. No. 3,414,043 issued on Dec. 3, 1968 to A. R. Wagner, discloses a casting process in which a mold is formed between advancing single-use strips. The strips are made of the same material as the molten metal (which is not identified), but strip material may be incorporated into the final product, which is obviously not acceptable for belt casters.

There is therefore a need for improvements in the belts used in belt casting machines of the type described above.

DISCLOSURE OF THE INVENTION

An object of the present invention is to provide belts for belt casting machines that are more convenient to fabricate and use than conventional belts made of textured steel and/or copper.

Another object of the present invention is to provide belts for casting machines that may be used for casting a wide range of alloy types and operating under a wide range of heat removal rates without having to change belts between alloy types.

According to one aspect of the present invention, there is provided a continuous belt casting apparatus for continuously casting metal strip, comprising: at least one movable endless belt having a casting surface at least partially defining a casting cavity, means for advancing said at least one endless belt through the casting cavity, means for injecting molten metal into said casting cavity, and means for cooling said at least one endless belt as it passes through the casting cavity, wherein said at least one endless belt is made of aluminum or an aluminum alloy.

According to another aspect of the invention, there is provided a process of casting a molten metal in a form of strip, which comprises: providing at least one casting belt made of aluminum or an aluminum alloy and having a casting surface which at least partially defines a casting cavity, continuously advancing said at least one casting belt through the casting cavity, supplying the molten metal to an inlet of the casting cavity, cooling said at least one casting belt is it passes through the casting cavity, and continuously collecting the resulting cast strip from an outlet of the casting cavity.

According to yet another aspect of the invention, there is provided a casting belt adapted for use in a continuous casting apparatus having at least one movable endless belt provided with a casting surface at least partially defining a casting cavity, means for advancing said at least one endless belt through the casting cavity, means for injecting molten metal into said casting cavity, and means for cooling said at least one endless belt as it passes through the casting cavity, wherein said casting belt is made of aluminum or an aluminum alloy.

In the present invention, the casting belt preferably has a thickness in a range of 1 to 2 mm, and is preferably made of a metal selected from AA5XXX and AA6XXX alloy systems. Further, the casting belt of the invention preferably has a yield strength of at least 100 MPa and a thermal conductivity greater than 120 W/m-K.

The casting belt of the invention may be used for casting non-ferrous and light metals such as aluminum, magnesium, copper, zinc and their alloys, especially aluminum alloys such as Al—Mg, Al—Mg—Si, Al—Fe—Si and Al—Fe—Mn—Si alloy systems.

It has unexpectedly been found that aluminum belts possess unique properties that make them suitable for the flexible belt casting operation required in modern belt casters. In such casters, belts are required to remain stable (no permanent deformation) under severe thermal stresses, and are required to comply with the entry curve at the upstream end of the casting cavity, even when "floating" on a coolant layer. The combination of properties required to achieve such a performance is complicated, and depends, for example, on the material thermal conductivity, strength, modulus and thermal expansion coefficients.

The present invention has the advantage that aluminum alloy belts are easier to fabricate (less expensive) than either steel or copper belts. Aluminum belts suffer less "plastic set" than typical copper belts. Plastic set is the tendency for a metal strip or belt to take on a permanent deformation when subjected to thermal distortion forces. Belts that resist plastic set return elastically to their original shape when the thermal distorting stress is removed. It is believed that plastic set is governed by the specific stiffness (Young's Modulus/Density) and specific strength (Yield Strength/Density) with higher values of both favoring a resistance to plastic set. Aluminum alloys are generally superior to copper in this respect. It is particularly preferred that aluminum alloy belts have yield strengths in the range of over 100 MPa to ensure resistance to plastic set.

It has been found that aluminum belts can impart improved surface quality to certain alloys, such as fin and foil alloys of the Al—Fe—Si or Al—Fe—Si—Mn type, and offer a broader range of castability than either steel or copper belts. Such alloys are also often referred to as "short freezing range alloys" and in the past have presented certain problems during belt casting. For example, fin and foil alloys can be cast on textured or ceramic-coated steel belts. The cast slabs made on these belts are free from shell distortion, but have a discrete surface segregation layer. If the alloys are cast on copper belts, the surface quality is good, but the slab internal quality is not acceptable because of shell distortion. When the foil alloys were cast on aluminum belts, the resulting slab was free of both surface segregation and shell distortion. Aluminum belts can also improve surface quality on Al—Mg and Al—Mg—Si automotive alloys by reducing the amount of shell distortion found when such allows are cast on copper belts.

BEST MODES FOR CARRYING OUT THE INVENTION

Figure 1:
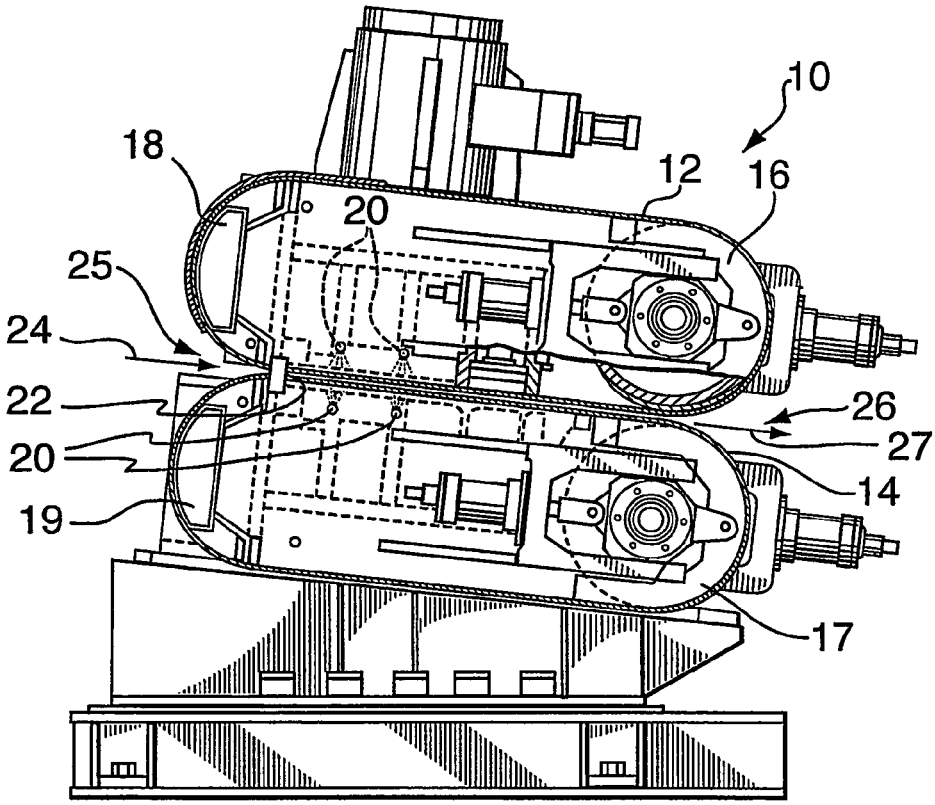
FIG. 1 is a simplified side view of a continuous twin-belt casting machine to which the present invention may apply.
Figure 2:
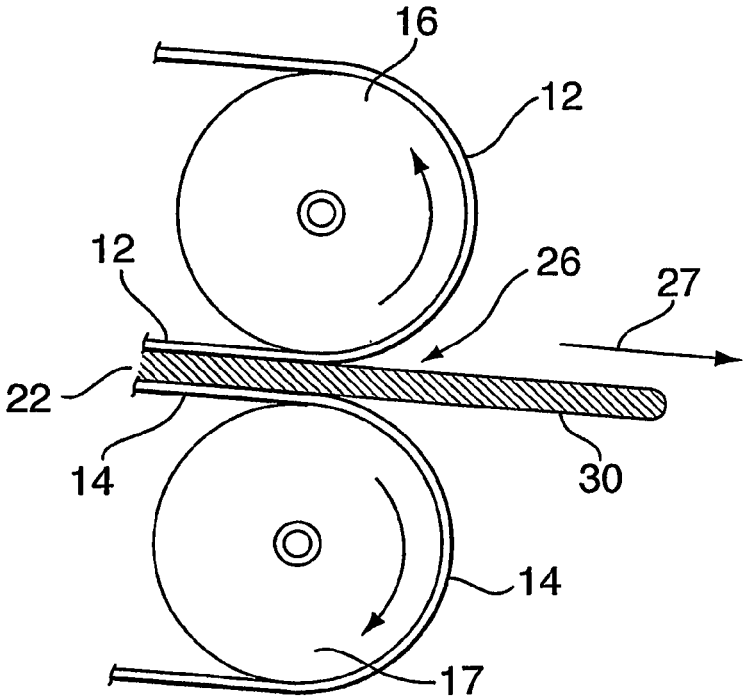
FIG. 2 is an enlarged view of the exit portion of the casting machine in FIG. 1.

FIGS. 1 and 2 show (in simplified form) a twin-belt casting machine 10 for continuous-casting a molten metal such as molten aluminum alloy in the form of a strip. The present invention may apply, but by no means exclusively, to the casting belts disclosed, for example, in U.S. Pat. No. 4,061,177 and No. 4,061,178, the disclosures of which is incorporated herein by reference. It is noted that the principles of the present invention can also be successfully implemented to the casting belt of a single belt casting system. The brief structure and operation of the continuous belt casting machine of FIGS. 1 and 2 are explained below.

As shown in FIGS. 1 and 2, the casting machine 10 includes a pair of endless flexible casting belts 12 and 14, each of which is carried by an upper pulley 16 and lower pulley 17 at one end and an upper liquid bearing 18 and lower liquid bearing 19 at the other end. Each pulley is rotatably mounted on a support structure of the machine and is driven by suitable driving means. For the purpose of simplicity, the support structure and the driving means are not illustrated in FIGS. 1 and 2. The casting belts 12 and 14 are arranged to run substantially parallel to each other (preferably with a small degree of convergence) at substantially the same speed through a region in which they define a casting cavity 22 (also, referred to as a mould) therebetween, i.e. between adjacent casting surfaces of the belts. The casting cavity 22 can be adjusted in the width, depending on the desired thickness of the metal strip being cast. A molten metal is continuously supplied into the casting cavity 22 in the direction of the arrow 24 through entrance 25 while the belts are cooled at their reverse faces, for example, by direct impingement of coolant liquid 20 on the reverse surfaces.

In the illustrated apparatus, the path of the molten metal being cast is substantially horizontal with a small degree of downward slope from entrance 25 to exit 26 of the casting cavity.

Molten metal is supplied to the casting cavity 22 by a suitable launder or trough (not shown) which is disposed at the entrance 25 of the casting cavity 22. For example, the molten metal injector described in U.S. Pat. No. 5,636,681, which is assigned to the assignee of this application, may be used for supplying molten metal to the casting machine 10. Although not shown, an edge dam is provided at each side of the machine so as to complete the enclosure of the casting cavity 22 at its edges. It will be understood that in the operation of the casting machine, the molten metal supplied to the entrance 25 of the casting cavity 22 advances through the casting cavity 22 to the exit 26 thereof by means of continuous motion of the belts 12, 14. During the travel along the casting cavity (moving mold) 22, heat from the metal is transferred through the belts 12, 14 and removed therefrom by the supplied coolant 20, and thus the molten metal becomes progressively solidified from its upper and lower faces inward in contact with the casting surfaces of the belts. The molten metal is fully solidified before reaching the exit 26 of the casting cavity and emerges from the exit 26 in the direction shown by arrow 27 in the form of a continuous, solid, cast strip 30 (FIG. 2), of which thickness is determined by means of the width of the casting cavity 22 as defined by the casting surfaces of the belts 12 and 14. The width of the cast strip 30 corresponds to that of the casting belts 12, 14.

According to the present invention, aluminum or an aluminum alloy is used as the material for the casting belts 12, 14 for the twin-belt casting machines 10, especially to be used for the casting of non-ferrous and light metals, such as aluminum, magnesium, copper, zinc or their alloys. Whilst most aluminum alloys are suitable for the material of the belts, alloys of the Al—Mg (AA5XXX type) or Al—Mg—Si (AA6XXX type) are particularly suitable since they provide for the widest possible of stable heat flux operation, and hence are most suitable for use in casters used for multiple product types and/or operated over a range of casting speeds. Particularly preferred alloys are AA5754, AA5052 and AA6061.

In general, any aluminum alloy that is easily weldable, of a suitable gauge and a good yield strength (preferably at least 100 MPa) that is either strain hardened or heat-treated may be employed. The belts of the invention are normally fabricated with a thickness in the range of 1 to 2 mm, although thinner or thicker belts may be provided for specific applications.

The fact that casting belts made of aluminum alloys can be used for casting similar metals is surprising. It was previously believed by the inventors of the present invention that the thermal distortion of an aluminum belt, cooled on its reverse surface, by the impinging molten aluminum due to the high thermal expansion of aluminum compared to both steel and copper would degrade the surface quality of the cast ingot. However, provided that there is sufficient cooling through the cross-section of the belts, e.g. as supplied by water jets (preferably flowing at high speed) issuing from cooling nozzles onto the rear surfaces of the belts, aluminum alloy belts may be used effectively and safely for the casting of non-ferrous and light metals. Moreover, the use of a parting agent and suitable belt tension permits a high quality, safe casting process to occur.

It has been further surprisingly found that fin and foil alloys, which are normally cast on textured steel belts, can be better cast with better surface quality on aluminum alloy belts. Typically these fin and foil alloys are of the Al—Fe—Si or Al—Fe—Mn—Si system, and have compositions comprising: Fe in an amount of 0.06 to 2.2 wt. %, Si in an amount of 0.05 to 1.0 wt. %, and may include Mn up to 1.5 wt. %.

In addition, aluminum belts provide a capability of casting a wide range of aluminum alloys such as short freezing range Al—Fe—Si alloys and long freezing range Al—Mg alloys on one type of belt, rather than having to switch between steel and copper belts for different alloys. There does not seem to be any limit on the kind of aluminum alloy that may be cast on the belts of the present invention.

Figure 3:
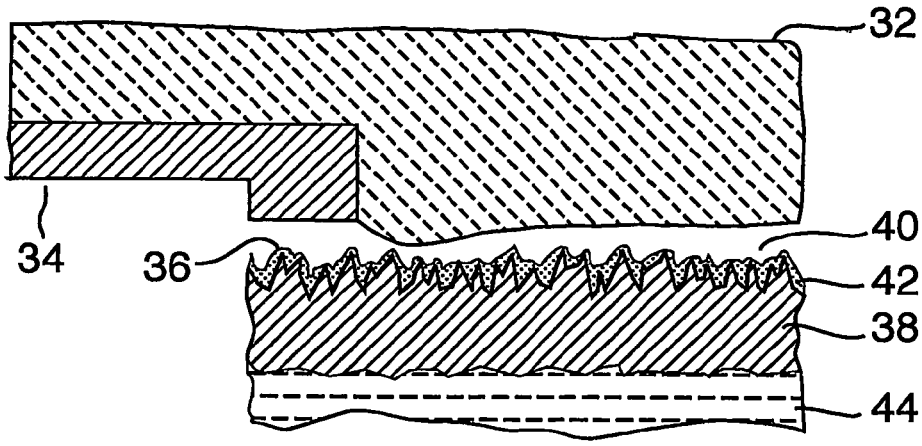
FIG. 3 is an enlarged partial cross-section of a twin-belt casting machine in the region where a molten metal is introduced into the casting cavity.

As noted above, the aluminum alloy belts of the present invention may be employed for casting similar molten metals because of the cooling that takes place to prevent the belts being heated above a temperature at which they become distorted, soften or melt. FIG. 3 shows a cross section of a casting belt in a belt casting machine during metal casting. The unevenness of the surface of the belt has been exaggerated in this drawing for ease of visualization. In FIG. 3, molten non-ferrous and/or light metal 32 (e.g. an aluminum alloy) pours from the end of a nozzle 34 onto a casting surface 36 of a moving casting belt 38, except that the metal remains separated from the casting surface 36 of the belt by a thin gas layer 40. The belt surface also has a layer 42 of parting agent, for example a liquid polymer layer or a layer of graphite powder, separating it from the gas layer. The use of a liquid parting agent layer in the present invention is preferred, but not essential. The parting agent layer helps to form the insulating gas layer 40. On the opposite side of the belt 38 to the casting surface 36, a layer 44 of cooling water is contacted with the belt to effect adequate cooling. In case of a twin-belt casting machine, the same structure exists at the upper part of the molten metal 32, although this structure is not shown in FIG. 3.

The casting surface 36 remains significantly shielded from the high temperature of the metal by the gas layer 40 and, to a much lesser extent, by the parting agent layer 42. Consequently the metal of the belt is never subjected to a temperature high enough to cause problems of distortion or melting. The coolant is applied to the reverse side of the belt by any convenient means, provided it provides sufficient heat extraction to ensure that the hot face temperature of the belt preferably remains below 120° C. and that the temperature drop across the belt is preferable less than 90° C. Coolant application apparatus described for example in U.S. Pat. No. 4,193,440 can provide sufficient cooling in a highly uniform manner (the disclosure of this patent is incorporated herein by reference).

As noted above, aluminum alloys have thermal conductivities intermediate those of steel and copper. The thermal conductivity of the belts is an important factor for the casting process. If it is low, the metal cools more slowly in the casting mold. If it is high, the metal cools more quickly. The rate at which heat is withdrawn from the molten metal (heat flux), depends to some extent on the thermal conductivity of the belt. Generally, for a particular type of alloy, there is a range of heat flux that results in suitable product quality. A belt that results in a heat flux approximately in the middle of this range is considered the most suitable for casting the alloy type. For short freezing range alloys, belts made of aluminum alloys result in an intermediate heat flux, and thus are the most suitable for casting the alloys of this type. Copper and steel belts tend to operate effectively at either end of the desired range of heat fluxes, thus requiring switching of belts to accommodate alloys of different compositions, whereas aluminum alloy belts can be used for all alloys of the indicated type.

In belt casters of the type described herein, a critical operating parameter is the maximum heat flux that can be sustained before the belt permanently deforms, resulting in inferior casting and the need to replace the casting belt. The maximum sustainable heat flux depends on the heat transfer between coolant and belt. Typically heat transfer coefficients can range from 10 to 60 kW/m-K depending of location. Table 1 lists the range of sustainable heat fluxes possible for belts of different materials under this range of heat transfer coefficient and same operating conditions (including belt thickness). Values for a typical steel belt, a copper belt material as described in U.S. Pat. No. 4,915,158 and aluminum alloy belts of the Al—Mg and Al—Mg—Si types are shown in the Table.

For aluminum belts, the preferred thermal conductivity is greater than 120 W/m-K and the preferred yield strength should be greater than 100 MPa. The aluminum alloys in Table 1 both exceed these preferred limits. As can be seen by this table, aluminum alloy belts provide for a range of critical heat fluxes that can be broader than steel, and overlap the portion of the copper range in the area where most casting operations of low freezing range alloys are carried out.

TABLE 1

Calculated critical heat flux for belt buckling for various casting belt materials

| Alloy | Critical heat fluxes ($MW/m^2$) for permanent distortion |
|---|---|
| Steel | 2.7-6.0 |
| AA5754-H32 | 1.9-5.9 |
| AA6061-T6 | 2.8-9.5 |
| Copper | 2.1-9.4 |

Of course, this performance may be further modified (reduction in maximum heat flux) by applying coatings, parting layers and other finishes to the belts such as surface anodizing. It is also preferred that the belts be provided with a textured surface.

The invention is illustrated further with reference to the Example below. This Example is not intended to limit the scope of the present invention.

EXAMPLE 1

Figure 4A:
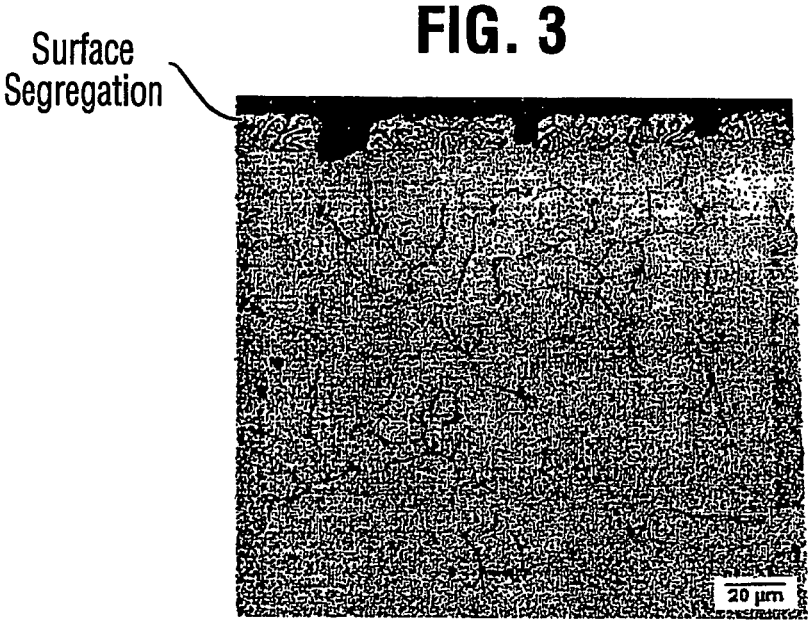
FIGS. 4*a* and 4*b* are micrographs showing the effect of a steel belt versus an aluminum belt on the surface segregation of an as-cast slab of a foil alloy.
Figure 4B:
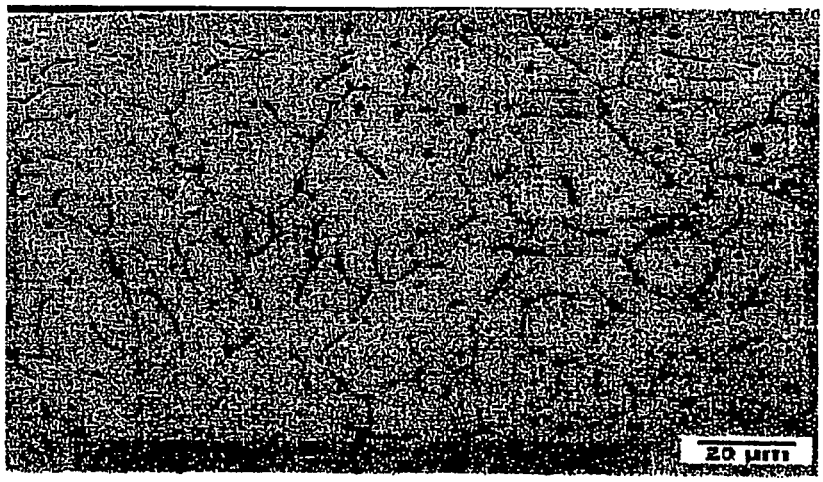
Figure 5A:
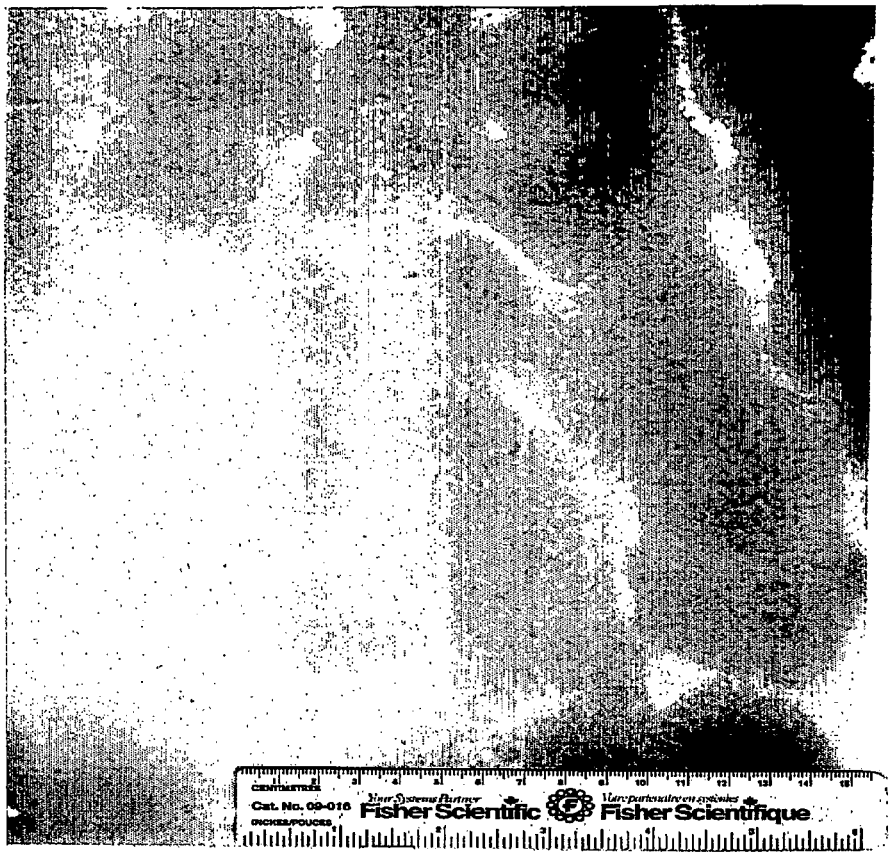
FIGS. 5*a* and 5*b* are radiographs showing the effect of an aluminum belt versus a copper belt on the internal structure of an as-cast slab of same foil alloy as in FIGS. 4*a* and 4*b;*
Figure 5B:
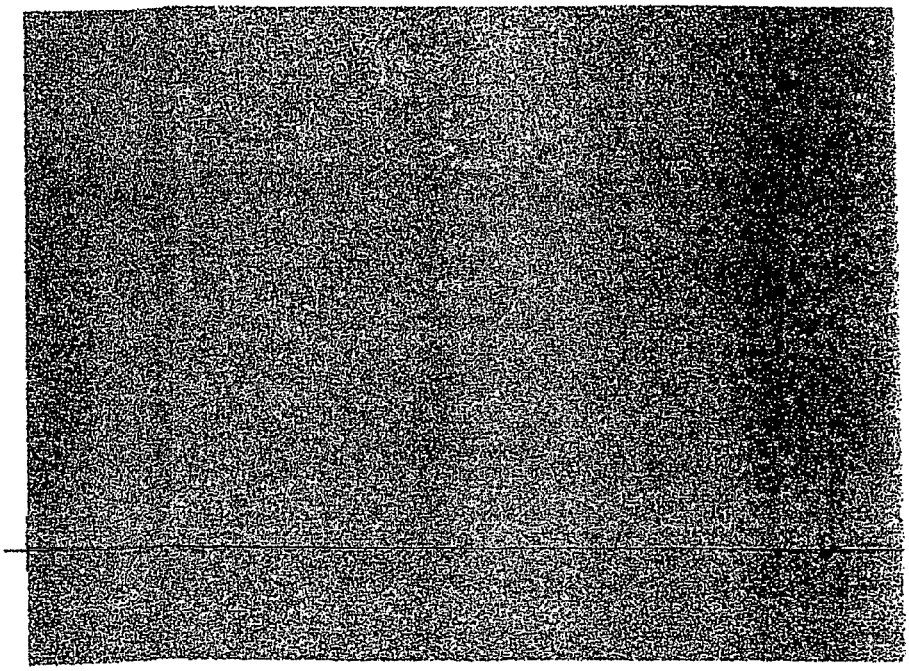

An aluminum alloy typically used for a typical Al—Fe—Si foil products (AA1145) was cast at 10 mm thickness each on belts of 0.060 inch thick of aluminum alloy AA5754 in a twin belt test bed. The belts were textured by applying a grinding belt to the surface to produce substantially longitudinal grooves having a roughness, measured transverse the grooves of about 25 micro-inches $R_a$ (The surface roughness value ($R_a$) is the arithmetic mean surface roughness.). Comparative samples were also cast on heavily textured steel and lightly textured Cu belts. Micrographs of the surface of material cast on the steel and aluminum belts is compared in FIGS. 4*a* and 4*b* and shows that steel belts (FIG. 4*a*) result in the production of a surface segregated layer whereas aluminum alloy belts (FIG. 4*b*) did not. Radiographs of the interior of cast slabs produced on Cu and aluminum alloy belts are compared in FIGS. 5*a* and 5*b*, respectively, and show that Cu belts (FIG. 5*a*) induce shell distortion in the material (areas appear as regions surrounded by light bands) whereas Al belts (FIG. 5*b*) do not.

EXAMPLE 2

Figure 6A:
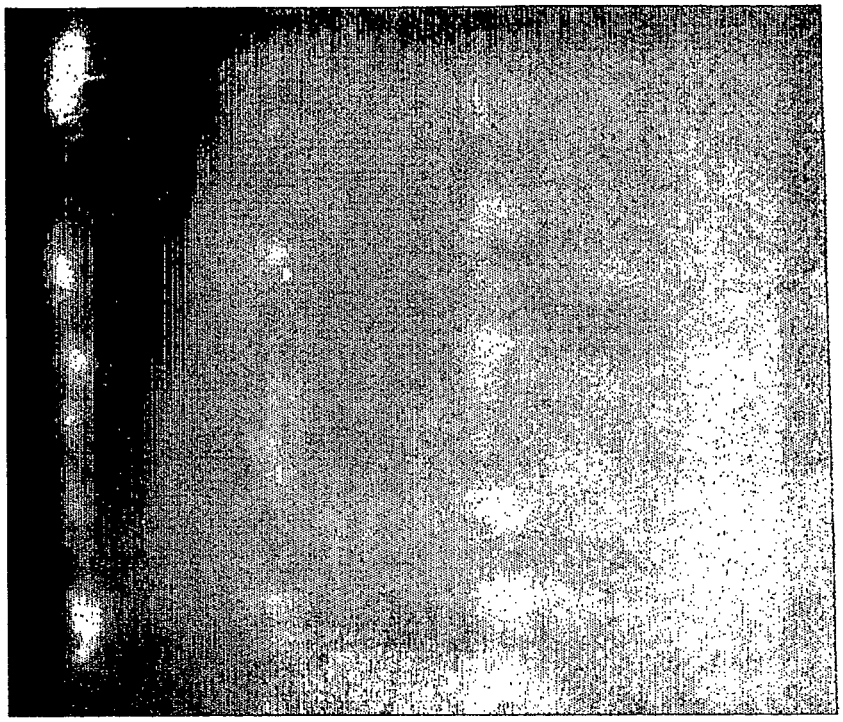
FIGS. 6*a* and 6*b* are radiographs showing the effect of an aluminum belt versus a copper belt on the internal structure of an as-cast slab of an Al—Mg alloy.
Figure 6B:
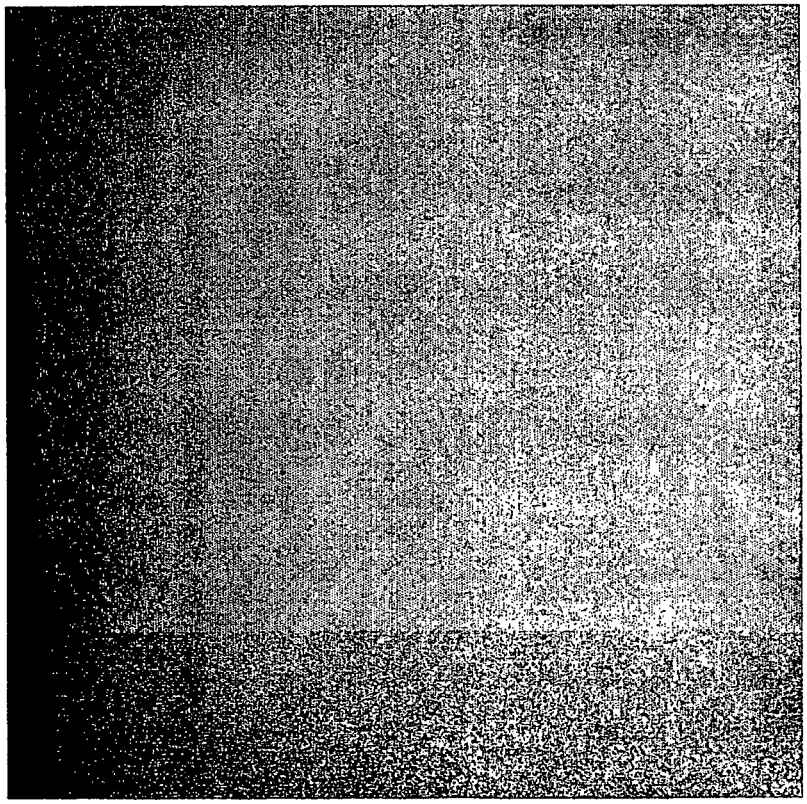
Figure 7A:
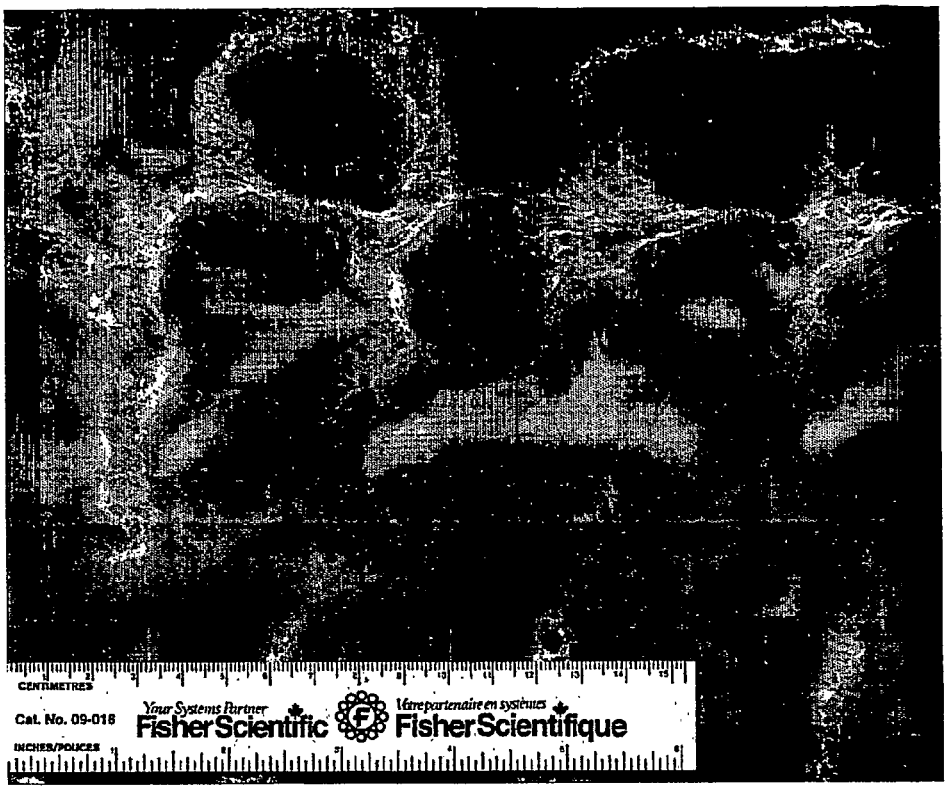
FIGS. 7*a* and 7*b* are optical photographs showing the effect on an aluminum belt versus a copper belt on the surface structure of an as-cast slab of the same alloy as in FIGS. 6*a* and 6*b.
Figure 7B:
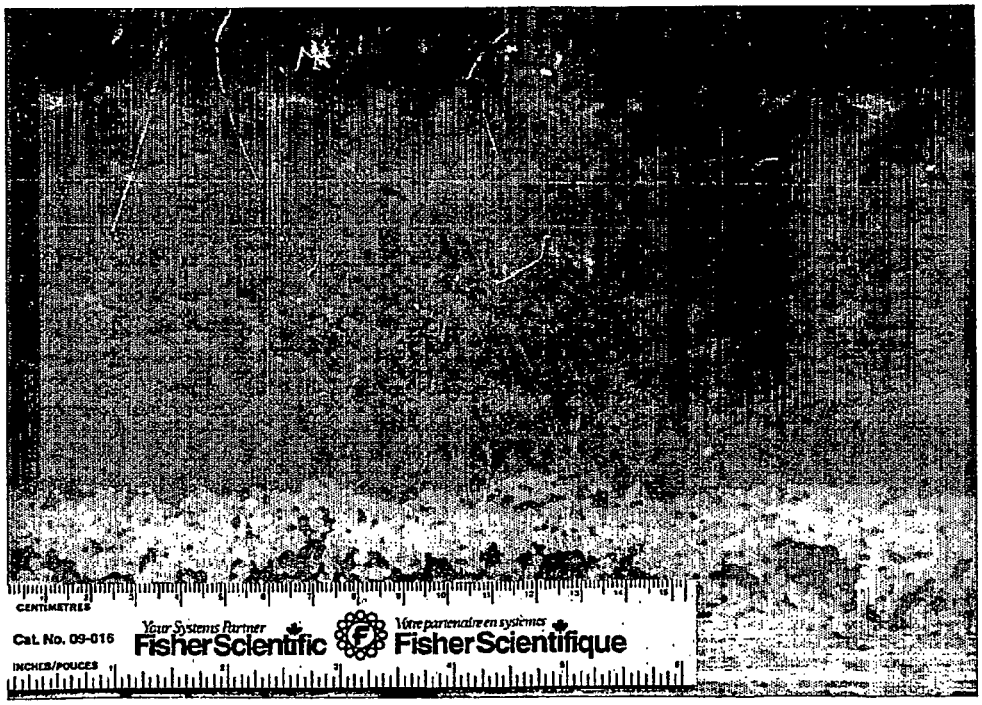

An aluminum Al—Mg (AA5754) alloy typically used for automotive applications was cast at 10 mm thickness each on belts of 0.060 inch thick of aluminum alloy AA5754 on a twin belt test bed. The belts were textured as described in Example 1. Comparative samples were also cast on lightly textured Cu belts. No casts were done on steel belts as the surface quality is excessively poor when cast on such belts. Radiographs (through-thickness X-ray prints) of the interior of cast slabs produced on Cu and aluminum alloy belts are compared in FIGS. 6*a* and 6*b*, respectively, and show that belts made of Cu (FIG. 6*a*) induce shell distortion in the material (areas appear as light patches in the radiograph) whereas Al (FIG. 6*b*) does not. Optical images were also made of the surfaces of the two castings and are compared for slabs produced on Cu and aluminum belts in FIGS. 7*a* and 7*b*, respectively. FIG. 7*a* shows the circular surface defects characteristic of shell distortion resulting from use of a Cu belt in a caster of this type, whereas FIG. 7*b* shows a defect free surface resulting from use of aluminum belts.

EXAMPLE 3

Figure 8A:
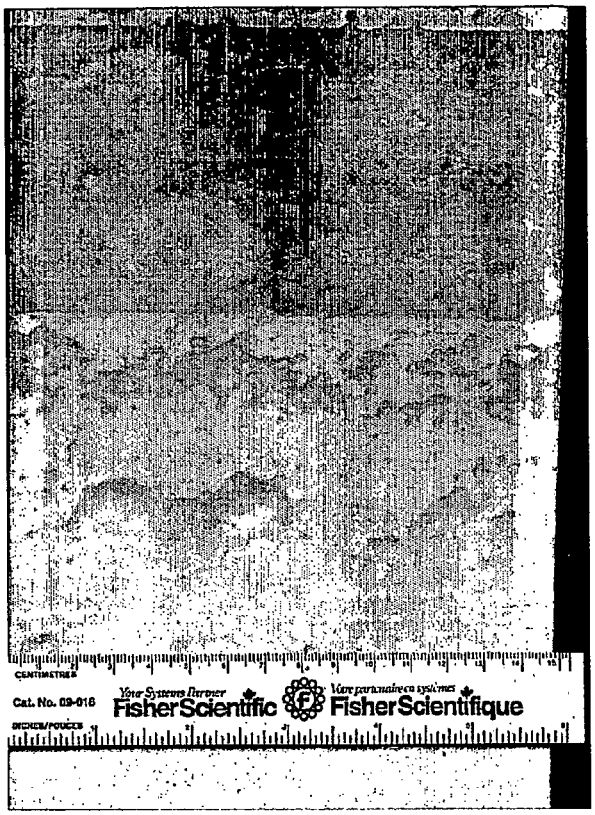
* and FIGS. 8*a* and 8*b* are optical photographs showing the effect of an aluminum belt versus a copper belt on the surface structure of an as-cast slab of an Al—Mg—Si alloy.
Figure 8B:
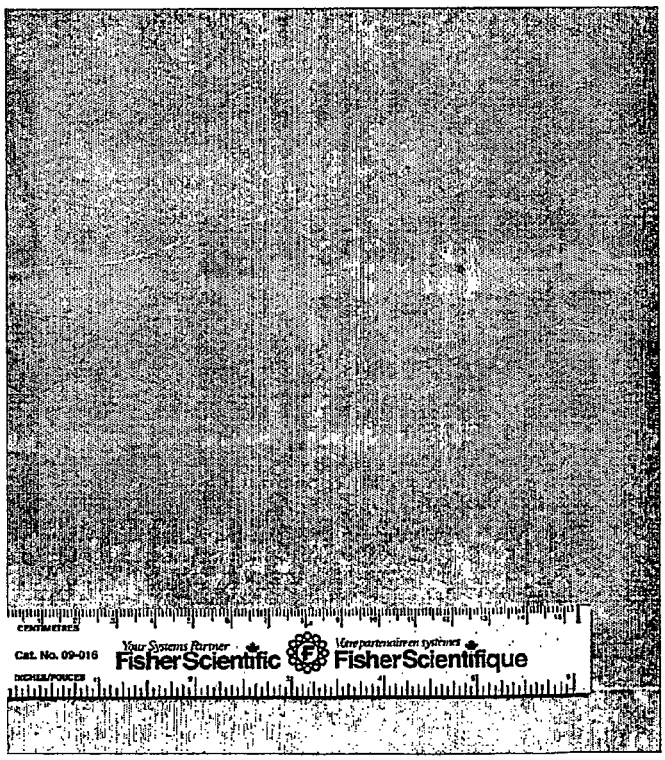

An aluminum Al—Mg—Si (AA6111) alloy also typically used for automotive applications was cast at 10 mm thickness each on belts of 0.060 inch thick of aluminum alloy AA5754 on a twin belt test bed. The belts were textured as described in Example 1. Comparative samples were also cast on lightly textured Cu belts. No casts were done on steel belts as the surface quality is generally poor when cast on such belts. Optical images were made of the surfaces of the two castings and are compared for slabs produced on Cu and aluminum belts in FIGS. 8*a* and 8*b* respectively. FIG. 8*a* shows that the surface quality resulting from use of a Cu belt in a caster of this type is again poorer than that resulting from use of an Al belt as illustrated in FIG. 8*b*.

While the present invention has been described with reference to several preferred embodiments, the description is illustrative of the invention and is not to be construed as limiting the invention. Various modifications and variations may occur to those skilled in the art without departing from the scope of the invention as defined by the appended claims.

The invention claimed is:

1. A continuous belt casting apparatus for continuously casting metal strip, comprising:

at least one movable endless belt having a casting surface at least partially defining a casting cavity, means for advancing said at least one endless belt through the casting cavity, means for injecting molten metal into said casting cavity, and means for cooling said at least one endless belt as it passes through the casting cavity, wherein said at least one endless belt is made of aluminum or an aluminum alloy.

2. The apparatus of claim 1, wherein said at least one casting belt has a thickness in a range of 1 to 2 mm.

3. The apparatus of claim 1, wherein the aluminum alloy is selected from the group consisting of AA5XXX and AA6XXX alloy systems.

4. The apparatus of claim 1, wherein the aluminum alloy is selected from the group consisting of AA5754, AA5052 and AA6061.

5. The apparatus of claim 1, wherein said at least one casting belt has a yi6ld strength of at least 100 MPa.

6. The apparatus of claim 1, wherein said at least one casting belt has a thermal conductivity greater than 120 W/m-K.

7. The apparatus of claim 1, being a twin belt caster having two said endless belts made of said aluminum or aluminum alloy.

8. A process of casting a molten metal in a form of strip, which comprises: providing at least one casting belt made of aluminum or an aluminum alloy and having a casting surface which at least partially defines a casting cavity, continuously advancing said at least one casting belt through the casting cavity, supplying the molten metal to an inlet of the casting cavity, cooling said at least one casting belt as it passes through the casting cavity, and continuously collecting the resulting cast strip from an outlet of the casting cavity.

9. The process of claim 8, wherein said step of supplying molten metal to the mould comprises supplying molten aluminum, magnesium. copper, zinc or an alloy thereof.

10. The process of claim 8, wherein said step of supplying molten metal to the casting cavity comprises supplying molten aluminum or an aluminum alloy.

11. The process of claim 8, wherein the step of supplying molten metal to the casting cavity comprises supplying an Al—Fe—Si or Al—Fe—Mn—Si alloy.

12. The process of claim 9, wherein the step of supplying molten metal to the casting cavity comprises supplying an Al—Mg or Al—Si—Mg alloy.

13. The process of claim 8, which further comprises a step of applying a parting agent to said casting surface before said at least one belt is advanced through the casting cavity.

14. The process of claim 8, which comprises providing a belt having a thickness in a range of 1 to 2 mm as said at least one casting belt.

15. The process of claim 8, which comprises providing a belt made of an aluminum alloy of the AA5XXX or AA6XXX alloy systems as said at least one casting belt.

16. The process of claim 8, which comprises providing a belt having a yield strength of at least 100 MPa as said casting belt.

17. The process of claim 8, which comprises providing a belt having a thermal conductivity greater than 120 W/m-K as said at least one casting belt.

* * * * *